US010665220B1

(12) United States Patent
Nielsen

(10) Patent No.: US 10,665,220 B1
(45) Date of Patent: May 26, 2020

(54) ACTIVE NOISE REDUCTION (ANR) SYSTEM WITH MULTIPLE FEEDFORWARD MICROPHONES AND MULTIPLE CONTROLLERS

(71) Applicant: Bose Corporation, Framingham, MA (US)

(72) Inventor: Ole Mattis Nielsen, Cambridge (GB)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/292,908

(22) Filed: Mar. 5, 2019

(51) Int. Cl.
*G10K 11/178* (2006.01)
*H04R 3/00* (2006.01)
*H04R 1/40* (2006.01)

(52) U.S. Cl.
CPC .. *G10K 11/17873* (2018.01); *G10K 11/17823* (2018.01); *G10K 11/17853* (2018.01); *H04R 1/406* (2013.01); *H04R 3/005* (2013.01); *G10K 2210/3027* (2013.01); *G10K 2210/3028* (2013.01)

(58) Field of Classification Search
CPC ..... G10K 11/17873; G10K 11/17823; G10K 11/17853; G10K 11/1788; G10K 11/178; G10K 2210/3027; G10K 2210/3028; G10K 2210/1081; H04R 1/406; H04R 1/1083; H04R 3/005; H04R 5/033
USPC ..... 381/71.1, 71.6
See application file for complete search history.

(56) References Cited

U.S. PATENT DOCUMENTS

| | | | | |
|---|---|---|---|---|
| 8,073,150 | B2 | 12/2011 | Joho et al. | |
| 8,073,151 | B2 | 12/2011 | Joho et al. | |
| 8,472,636 | B2 | 6/2013 | Sibbald | |
| 9,082,388 | B2 | 7/2015 | Annunziato et al. | |
| 9,762,990 | B2 | 9/2017 | Sapiejewski et al. | |
| 2015/0172813 | A1* | 6/2015 | Goto | H04R 3/002 381/71.1 |
| 2016/0267899 | A1* | 9/2016 | Gauger, Jr. | H04R 3/005 |

* cited by examiner

*Primary Examiner* — Ahmad F. Mater
*Assistant Examiner* — Sabrina Diaz
(74) *Attorney, Agent, or Firm* — Fish & Richardson P.C.

(57) ABSTRACT

Technology described in this document can be embodied in a method that includes receiving a first input signal captured by at least a first feedforward microphone associated with an active noise reduction (ANR) device, receiving a second input signal captured by at least a second feedforward microphone associated with the ANR device, processing the first input signal using a first filter disposed in a first ANR signal flow path to generate a first output signal for an acoustic transducer of the ANR device, processing the second input signal using a second filter disposed in a second ANR signal flow path to generate a second output signal for the acoustic transducer, in which the second filter is different from the first filter, and generating a combined signal for the acoustic transducer based on combining the first output signal with the second output signal.

20 Claims, 6 Drawing Sheets

300

ACTIVE NOISE REDUCTION (ANR) SYSTEM WITH MULTIPLE FEEDFORWARD MICROPHONES AND MULTIPLE CONTROLLERS

TECHNICAL FIELD

This disclosure generally relates to active noise reduction (ANR) devices and more particularly to ANR devices having multiple feedforward microphones.

BACKGROUND

Acoustic devices such as headphones can include active noise reduction (ANR) capabilities that block at least portions of ambient noise from reaching the ear of a user. A single feedforward microphone is favored in many acoustic devices because it is low-cost and easy to implement. The performance of these devices can be estimated in terms of a level of coherence between the noise signals at the positions of the microphone outside of the devices and a virtual microphone inside the devices (e.g., a user's ear). The coherence of these devices, however, may be degraded when there are noise signals from multiple noise sources that cannot be captured by a single feedforward microphone.

SUMMARY

In general, in one aspect, this document features a method that includes receiving a first input signal captured by at least a first feedforward microphone associated with an active noise reduction (ANR) device and receiving a second input signal captured by at least a second feedforward microphone associated with the ANR device. The method further includes processing the first input signal using a first filter disposed in a first ANR signal flow path to generate a first output signal for an acoustic transducer of the ANR device and processing the second input signal using a second filter disposed in a second ANR signal flow path to generate a second output signal for the acoustic transducer. The method includes generating an output signal for the acoustic transducer based on combining the first output signal with the second output signal. The second filter is different from the first filter.

In another aspect, this document features an active noise reduction (ANR) device that includes a first feedforward microphone configured to capture a first input signal and a second feedforward microphone configured to capture a second input signal. The ANR device further includes an acoustic transducer configured to generate output audio. The ANR device includes a first filter disposed in a first ANR signal flow path of the ANR device. The first filter is configured to process the first input signal to generate a first output signal for an acoustic transducer of the ANR device. The ANR device includes a second filter disposed in a second ANR signal flow path of the ANR device. The second filter is configured to process the second input signal to generate a second output signal for the acoustic transducer. The second filter being different from the first filter. The acoustic transducer is driven by an output signal that is a combination of the first output signal and the second output signal.

In another aspect, this document features one or more machine-readable storage devices having encoded thereon computer readable instructions for causing one or more processing devices to perform various operations. The operations include receiving a first input signal captured by at least a first feedforward microphone associated with an active noise reduction (ANR) device, receiving a second input signal captured by at least a second feedforward microphone associated with the ANR device, processing the first input signal using a first filter disposed in a first ANR signal flow path to generate a first output signal for an acoustic transducer of the ANR device, processing the second input signal using a second filter disposed in a second ANR signal flow path to generate a second output signal for the acoustic transducer, in which the second filter is different from the first filter, and generating an output signal for the acoustic transducer based on combining the first output signal with the second output signal.

Implementations of the above aspects can include one or more of the following features.

The first ANR signal flow path and the second ANR signal flow path can be disposed in a feedforward signal flow path for the ANR device. At least one of the first or second input signal can be captured using multiple microphones.

The above method can further include receiving a third input signal captured by a third microphone associated with the ANR device, and processing the third input signal using a third filter of the ANR device to generate a third signal for the acoustic transducer. The output signal for the acoustic transducer can be generated based on combining the first output signal, the second output signal, and the third signal. The third filter can be different from the first filter and the second filter. In some cases, the third microphone is a feedforward microphone of the ANR device, and the third filter is disposed in a feedforward signal flow path for the ANR device. In some other cases, the third input signal is a feedback signal and the third microphone is a feedback microphone of the ANR device. In these other cases, the third filter is disposed in a feedback signal flow path that drives the output transducer to generate an anti-noise signal to reduce the effects of noise in the third input signal captured by the feedback microphone.

In another aspect, this document features an active noise reduction (ANR) headset earpiece that includes a first microphone disposed on the ANR headset earpiece such that the first microphone is configured to capture a first input signal representing noise traversing a first noise pathway through the ANR headset earpiece, and a second microphone disposed on the ANR headset earpiece such that the second microphone is configured to capture a second input signal representing noise traversing a second noise pathway through the ANR headset earpiece. Positions of the first microphone and the second microphone on the ANR headset earpiece are configured such that a first target level of coherence is achieved at multiple frequencies, the first target level of coherence at a particular frequency representing a fraction of an output signal that can be suppressed using the first input signal and the second input signal together.

In yet another aspect, this document features a method including: providing a first microphone on an active noise reduction (ANR) headset earpiece such that the first microphone is configured to capture a first input signal representing noise traversing a first noise pathway through the ANR headset earpiece, providing a second microphone on the ANR headset earpiece such that the second microphone is configured to capture a second input signal representing noise traversing a second noise pathway through the ANR headset earpiece, and configuring positions of the first microphone and the second microphone on the ANR headset earpiece such that a first target level of coherence is achieved at multiple frequencies, the first target level of coherence at a particular frequency representing a fraction of an output signal that can be suppressed using the first input signal and the second input signal together.

Implementations of the above two aspects can include one or more of the following features. The ANR headset earpiece can include a third microphone disposed on the ANR headset earpiece such that the third microphone is configured to capture a third input signal representing noise traversing a third noise pathway through the ANR headset earpiece. Positions of the first microphone, the second microphone, and the third microphone on the ANR headset cup are configured such that a second target level of coherence is achieved at multiple frequencies, the second target level of coherence at a particular frequency representing a fraction of the output signal that can be suppressed using the first, second, and third input signals together.

The first microphone and the second microphone can be feedforward microphones. The first noise pathway can include an acoustic path through a cushion of the headset earpiece. The second noise pathway can include an acoustic path through a port of the headset earpiece. In some implementations, the headset earpiece can have two separate ports including a mass port and a resistive port. In these implementations, the second noise pathway can include an acoustic path through a mass port or a resistive port. In some other implementations, the headset earpiece can have a port that can act as a mass port at some frequencies and as a resistive port at some other frequencies. The third noise pathway can include an acoustic path formed though a leak between the cushion of the headset earpiece and the head of a user of the ANR headset earpiece.

The ANR headset earpiece can further include: an acoustic transducer configured to generate an output audio; a first filter configured to process the first input signal to generate a first output signal for the acoustic transducer; and a second filter configured to process the second input signal to generate a second output signal for the acoustic transducer. The acoustic transducer can be driven by a combined signal that is a combination of the first output signal and the second output signal. In some implementations, the combined signal can include components that are combined at various portions of the electronics within the ANR headset.

Various implementations described herein may provide one or more of the following advantages. By placing multiple feedforward microphones at different strategic positions on the ANR device earpiece (for example, near the noise pathways of the ANR device earpiece and/or close to a cushion of the ANR device earpiece), the technology described herein can improve coherence of the ANR device, which in turn may lead to a better performance over existing ANR devices. In addition, the multiple feedforward microphones can be spread around the periphery of the earpiece, thereby enabling the ANR device to capture noise signals early from different directions. This in turn may allow for a faster generation of a corresponding anti-noise signal as compared to devices that rely on adjusting the noise reduction process based on feedback. The use of multiple feedforward microphones can potentially improve the performance of an ANR device in various different environments, particularly in those where the noise can come from different directions. For example, an ANR device with multiple microphones may provide significant advantages when being used in an airplane, in a crowded cafeteria, or in a moving vehicle where the noise comes from different noise sources.

Two or more of the features described in this disclosure, including those described in this summary section, may be combined to form implementations not specifically described herein. The details of one or more implementations are set forth in the accompanying drawings and the description below. Other features, objects, and advantages will be apparent from the description and drawings, and from the claims.

DETAILED DESCRIPTION

Figure 2:
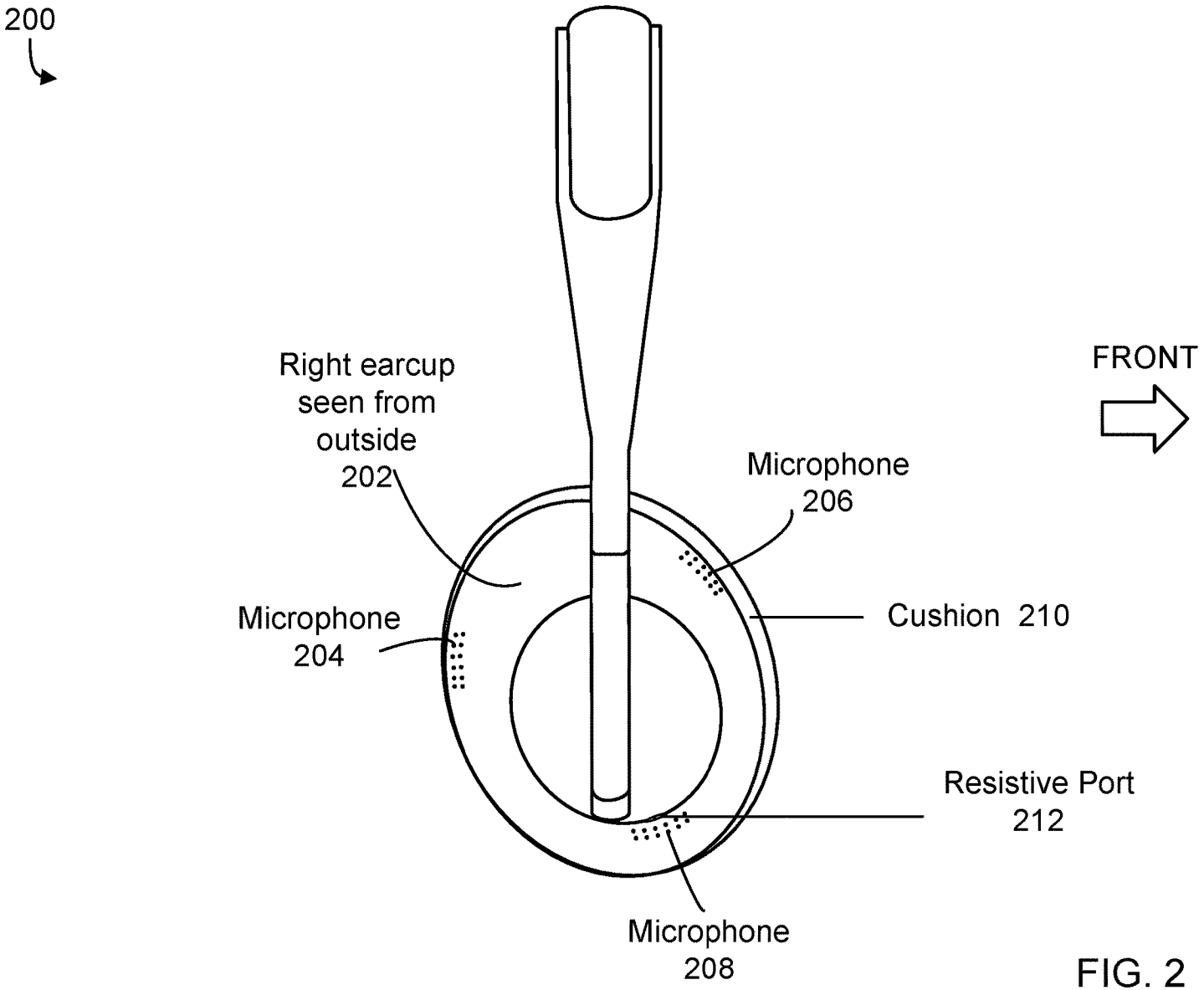
FIG. 2 illustrates an example over-the-ear ANR headphone that has an earpiece with three feedforward microphones.

This document describes technology for implementing multiple feedforward microphones in an Active Noise Reduction (ANR) device to improve performance of the ANR device. ANR devices such as ANR headphones are used for providing potentially immersive listening experiences by reducing effects of ambient noise and sounds. Many ANR devices use a single feedforward microphone for noise reduction due to its low-cost and simple implementation. However, the performance of these devices may be limited when the noise is coming from different directions. The performance of ANR devices can be estimated in terms of a level of coherence, which represents, at each frequency, the fraction of the power of an output signal that can be canceled/suppressed using an input from a feedforward microphone. The coherence of these devices may be degraded when noise signals from multiple noise sources are not adequately captured by a single feedforward microphone. Feedforward microphones, as used in this document, refer to microphones that are disposed at an outward-facing portion of the ANR headphone (e.g., on the outside of an earcup 202 of FIG. 2) with a primary purpose of capturing ambient sounds. Examples of a feedforward microphone are shown in FIG. 2, for example, feedforward microphones 204, 206, and 208 disposed on the outside of the earcup 202. Feedback microphones refer to microphones that are disposed proximate to an acoustic transducer of the ANR headphone (e.g., inside an earcup) with a primary purpose of capturing noise in the same sound field as the ear (which is different from the sound field of the ambient where the feedforward microphones are).

The technology described herein allows for the implementation of an ANR device that has multiple feedforward microphones disposed on the outside of an earpiece of the ANR device. By placing multiple feedforward microphones at different strategic positions on the ANR device earpiece (for example, near the noise pathways of the ANR device earpiece and/or close to a cushion of the ANR device earpiece), the technology described herein can improve coherence of the ANR device, which in turn may lead to a better performance over existing ANR devices. In addition, the multiple feedforward microphones can be spread around the periphery of the earpiece, thereby enabling the ANR device to capture noise signals early from different directions. This in turn may allow for a faster generation of a corresponding anti-noise signal as compared to devices that rely on adjusting the noise reduction process based on feedback. The use of multiple feedforward microphones can potentially improve the performance of an ANR device in various different environments, particularly in those where the noise can come from different directions. For example, an ANR device with multiple microphones may provide significant advantages in a moving vehicle where the noise comes from different noise sources such as the engine, external vehicles and windshield wipers.

Figure 1:
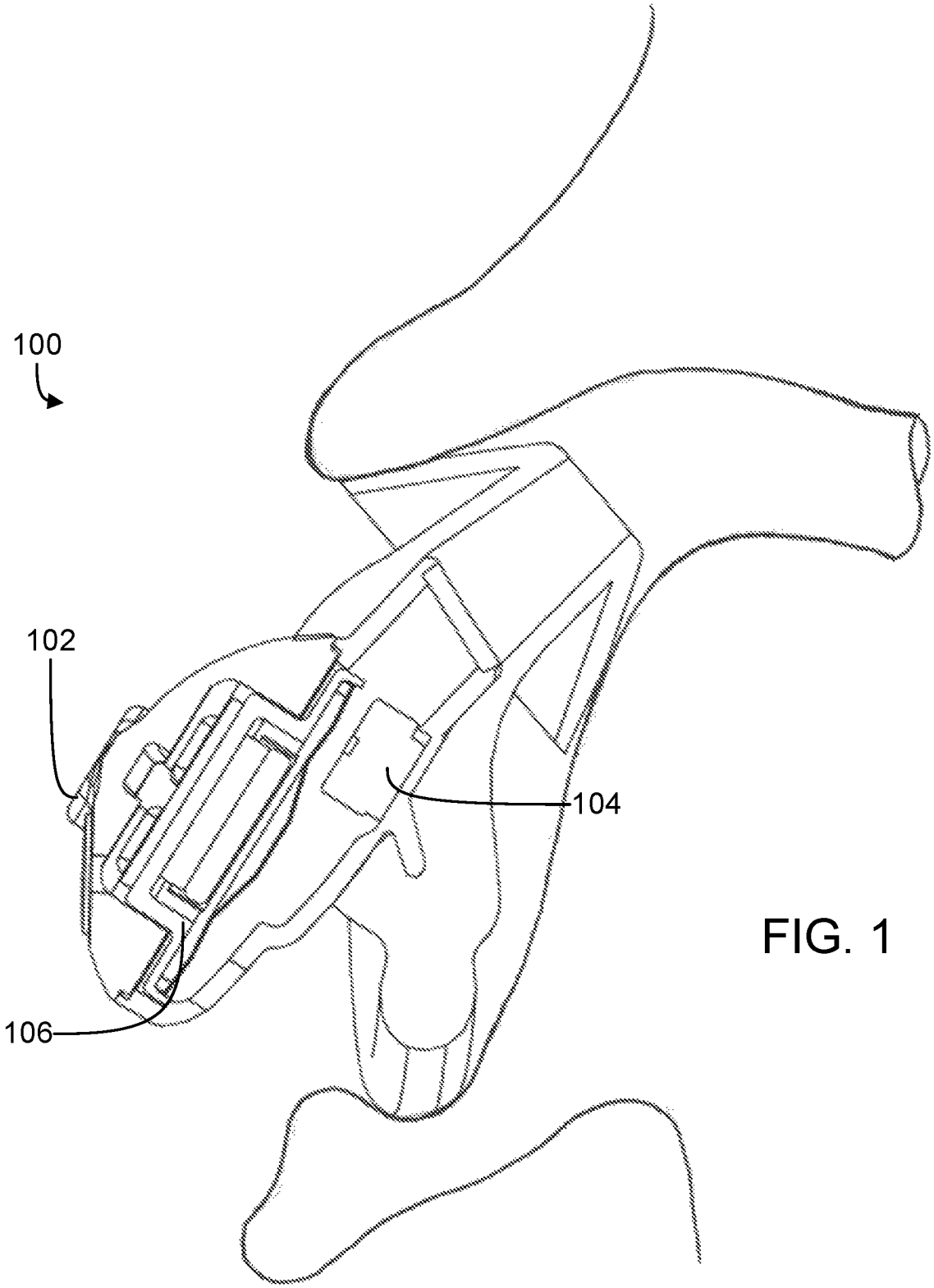
FIG. 1 shows an example of an in-the-ear active noise reduction (ANR) headphone.

An active noise reduction (ANR) device can include a configurable digital signal processor (DSP), which can be used for implementing various signal flow topologies and filter configurations. Examples of such DSPs are described in U.S. Pat. Nos. 8,073,150 and 8,073,151, which are incorporated herein by reference in their entirety. U.S. Pat. No. 9,082,388, also incorporated herein by reference in its entirety, describes an acoustic implementation of an in-ear active noise reducing (ANR) headphone, as shown in FIG. 1. This headphone 100 includes a feedforward microphone 102, a feedback microphone 104, an output transducer 106 (which may also be referred to as an electroacoustic transducer or acoustic transducer), and a noise reduction circuit (not shown) coupled to both microphones and the output transducer to provide anti-noise signals to the output transducer based on the signals detected at both microphones. An additional input (not shown in FIG. 1) to the circuit provides additional audio signals, such as music or communication signals, for playback over the output transducer 106 independently of the noise reduction signals.

The term headphone, which is interchangeably used herein with the term headset, includes various types of personal acoustic devices such as in-ear, around-ear or over-the-ear headsets, earphones, and hearing aids. The headsets or headphones can include an earbud or ear cup for each ear. The earbuds or ear cups may be physically tethered to each other, for example, by a cord, an over-the-head bridge or headband, or a behind-the-head retaining structure. In some implementations, the earbuds or ear cups of a headphone may be connected to one another via a wireless link.

For an ANR device that has a single feedforward microphone configured to capture a single input signal, the performance of the ANR device can be estimated by a coherence between (i) the input signal at the position of the feedforward microphone (placed on the outside of the devices) and (ii) an output signal measured at a user's ear. In particular, the coherence between the two signals is a frequency domain quantity that quantifies a degree that the two signals are linearly correlated to each other. The coherence is a number between 0 and 1 at each frequency. Assuming that the input signal at time step t is x(t) and the output signal at time step t is y(t), with x(t) to y(t) being time domain quantities, then the coherence from x(t) to y(t) is the same as the coherence from y(t) to x(t). The coherence between x(t) and y(t) can be denoted as $\gamma_{YX}^2$, which reflects that it is a power quantity. The coherence can be calculated using the following equation:

$$\gamma_{YX}^2(\omega) = \frac{|S_{YX}(\omega)|^2}{S_{XX}(\omega)S_{YY}(\omega)}. \tag{1}$$

In the above equation, $S_{XX}(\omega)$ is a power spectrum of x(t), which is the expected value of a magnitude squared of the Fourier transform of x as shown below:

$$S_{XX}(\omega)=E[X(\omega)X(\omega)^*]=E[|X(\omega)|^2], \tag{2}$$

where ω is the frequency and $S_{XX}(\omega)$ is a frequency domain quantity.

Similarly, $S_{YY}(\omega)$ is the power spectrum of y(t) and can be computed as follows:

$$S_{YY}(\omega)=E[Y(\omega)Y(\omega)^*]=E[|Y(\omega)|^2] \tag{3}$$

$S_{YX}(\omega)$ is the cross-spectrum between x(t) and y(t):

$$S_{YX}(\omega)=E[Y(\omega)X(\omega)^*] \tag{4}$$

From a mathematical perspective, the coherence is the fraction of the power in the output signal y(t) that can be explained linearly by the input signal x(t). From an ANR perspective, the coherence represents, at each frequency, the fraction of the power in the output signal that can be canceled using the input signal.

The coherence of single feedforward microphone ANR devices may be reduced in the presence of noisy signals from multiple noise sources that are not adequately captured by the single feedforward microphone. The technology described herein may provide improved coherence (as compared to single feedforward microphone devices) by allowing for the use of multiple feedforward microphones in an ANR device (also referred to as an ANR headphone or headset). The performance of such devices may be further improved via strategic placement of the feedforward microphones at locations proximate to noise pathways (pathways through which ambient noise is likely to reach the ear of a user) of the ANR headphone.

For example, acoustic leaks between the skin of a user and a headphone cushion that contacts the skin form typical noise pathways during the use of a headphone. Accordingly, one or more of the multiple feedforward microphones can be placed near an outer periphery of a headphone earpiece (for example, near an outer periphery of an over-the-ear headset earcup) and close to the cushion of the earpiece. As another example, ports of an ANR headphone (e.g., a resistive port or a mass port, as described, for example, in U.S. Pat. No. 9,762,990, incorporated herein by reference) can also form noise pathways in headphones. Accordingly, one or more of the multiple feedforward microphones can be disposed near one or more of such ports of the ANR headphone. As described in U.S. Pat. No. 9,762,990, an ANR headphone may have a front cavity and a rear cavity separated by a driver, with a mass port tube connected to the rear cavity to present a reactive acoustic impedance to the rear cavity, in parallel with a resistive port. In some implementations, it may be beneficial to place at least one of the multiple feedforward microphones close to the resistive port or the mass port of the ANR headphone in order to improve the coherence. In some implementations, corresponding microphones may be placed proximate to both the resistive port and the mass port of the ANR device. For example, FIG. 2 shows an earcup 202 of an ANR device. The earcup 202 includes three microphones 204, 206, and 208. Microphone 206 can be placed proximate to a mass port (not shown) of the ANR device and microphone 208 can be placed proximate to a resistive port 212 of the ANR device.

Figure 3:
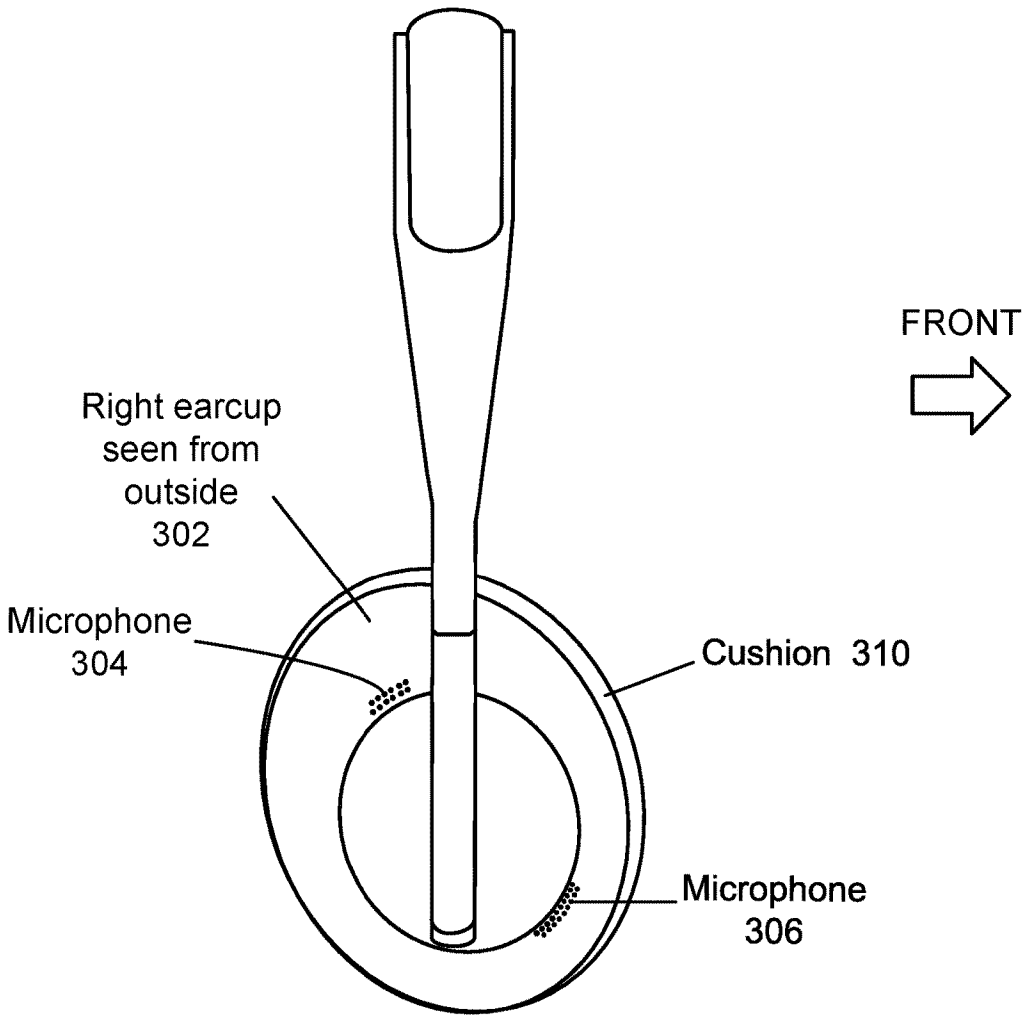
FIG. 3 illustrates an example over-the-ear ANR headphone that has an earpiece with two feedforward microphones.

In some implementations, the positions of the multiple microphones can be distributed around the earpiece so that the multiple microphones may capture noisy signals coming from different directions. When two microphones are used for feedforward active noise reduction, the two microphones can be placed, for example, at substantially diametrically opposite locations on an earpiece. For example, FIG. 3 shows an ANR headset earcup 302 that includes two microphones 304 and 306. The microphone 306 is placed towards the front of the earcup 302 and the microphone 304 is placed towards the rear of the earcup 302 in relation to the location of the microphone 306.

Relative positions of the multiple feedforward microphones are configured such that a target level of coherence is achieved. When multiple feedforward microphones are used, the coherence (also referred to as "multiple coherence" to distinguish from the coherence in the single feedforward microphone case) is computed as follows.

If $x_1(t)$, $x_2(t)$, . . . , $x_n(t)$ denote multiple input signals captured by multiple feedforward microphones, the multiple coherence of the ANR headphone can be computed as follows:

$$\gamma_{YX}^2(\omega) = \frac{1}{S_{YY}(\omega)} S_{YX}(\omega) S_{XX}^{-1}(\omega) S_{YX}^H(\omega) \tag{5}$$

where notations in bold denote a vector or a matrix (due to the multiple input signals), and $(.)^H$ denotes the Hermitian (complex conjugate transpose) of a matrix or vector. The multiple coherence $\gamma_{YX}^2$ is a single number between 0 and 1 at each frequency ω.

$S_{YX}(\omega)$ is a cross-spectrum vector between the input signal and output signal:

$$S_{YX}(\omega) = \begin{bmatrix} S_{YX_1}(\omega) \\ \vdots \\ S_{YX_n}(\omega) \end{bmatrix}, \tag{6}$$

where each element is defined using Eq. 4 above. In addition, instead of the power spectrum of the input signal, a cross-spectrum matrix of all the input signals is computed as:

$$S_{XX}(\omega) = \begin{bmatrix} S_{X_1X_1}(\omega) & \dots & S_{X_1X_n}(\omega) \\ \vdots & \ddots & \vdots \\ S_{X_nX_1}(\omega) & \dots & S_{X_nX_n}(\omega) \end{bmatrix} \tag{7}$$

The multiple coherence represents a fraction of the output signal (at the user's ear) that can be cancelled using all the input signals simultaneously. The relative positions of the multiple feedforward microphones on the ANR headphone earpiece are configured such that a target level of the multiple coherence is achieved. For example, the target level of multiple coherence can be 0.91, 0.94, 0.95 or any value between 0.9 and 0.9999.

FIG. 2 illustrates an example over-the-ear ANR headset 200 having an earpiece with three microphones. The earpiece is a right earcup 202 of the headset 200 viewed from outside. The earcup 202 has three microphones 204, 206, and 208, which are all feedforward microphones located near the outer periphery of the earcup housing (or earcup cover). While FIG. 2 illustrates three feedforward microphones 204, 206, and 208, in some implementations, a headset can have only two microphones which are feedforward microphones. In some other implementations, a headset can have two feedforward microphones and a feedback microphone. In some other implementations, a headset can have more than three feedforward microphones and optionally, a feedback microphone.

Generally, when three microphones are used, the positions of the three microphones are spread around the outer periphery of the earcup 202 to capture noisy input signals coming from different directions. The first microphone of the three microphones is disposed on the earcup 202 such that the first microphone is configured to capture a first input signal representing noise traversing a first noise pathway through the ANR headset earcup 202. The second microphone is disposed on the ANR headset earcup 202 such that the second microphone is configured to capture a second input signal representing noise traversing a second noise pathway through the ANR headset earcup 202. The third microphone is disposed on the ANR headset earcup 202 such that the third microphone is configured to capture a third input signal representing noise traversing a third noise pathway through the ANR headset earcup 202. Each of first, second, and third noise pathways can be selected from the following set of noise pathways: (i) an acoustic path through the cushion 210 of the earcup 202, (ii) an acoustic path through a port of the headset earcup 202, and (iii) an acoustic path formed through a leak between the cushion of the headset earcup 202 and the head of a user of the ANR headset 200.

In the example of FIG. 2, the positions of the microphones 204, 206, and 208 are evenly spread around the outer periphery of the earcup 202. The microphones 204 and 206 are placed close to the cushion 210 of the earcup 202 to capture input signals representing noise traversing through the cushion 210. The bottom microphone 208 is placed close to a resistive port 212 to capture an input signal representing noise traversing through the resistive port 212 of the earcup 202.

In some implementations, instead of having three microphones (two feedforward microphones and a feedback microphone, or three feedforward microphones), the earcup 202 can have more than two feedforward microphones and optionally, a feedback microphone. For example, the earcup 202 can have three, four or five feedforward microphones and a feedback microphone.

FIG. 3 illustrates an example around-the-ear ANR headset 300 having an earpiece with two feedforward microphones. The earpiece is a rightearcup 302 of the headset 300 viewed from outside. The earcup 302 has two feedforward microphones 304 and 306. Generally, when two feedforward microphones are used, the positions of the two microphones are disposed at approximately diametrically opposite locations on the earcup 302. In some implementations, this can maximize the ability of the microphones to capture input signals originating from different noise sources. One of the microphones is disposed on the earcup 302 such that the microphone is configured to capture a first input signal representing noise traversing a first noise pathway through the ANR headset earcup. The second microphone is disposed on the ANR headset earcup 302 such that the second microphone is configured to capture a second input signal representing noise traversing a second noise pathway through the ANR headset earcup 302. The first and second noise pathways can be selected from the following set of noise pathways: (i) an acoustic path through the cushion 310 of the earcup 302, (ii) an acoustic path through a port of the headset earcup 302, and (iii) an acoustic path formed through a leak between the cushion of the headset earcup 302 and the head of a user of the ANR headset 300.

In the example of FIG. 3, the microphones 304 and 306 are located at approximately diametrically opposite locations on the periphery of the earcup. The microphone 306 is placed towards the front of the earcup 302 and the microphone 304 is placed towards the rear of the earcup 302 in relation to the location of the microphone 306. During use, the microphone 304 is proximate to locations where the user's hair may come between the cushion 310 and the skin of the user, which in turn may cause noise leakage between the ambient environment and the ear. Therefore, the microphone 304 can capture an input signal representing noise traversing an acoustic path formed through the leak between the cushion 310 and the head of the user. In some implementations, it may be desirable to place the microphone 304 and 306 as close to the cushion 310 as possible to capture the leakage through. However, if the ANR headset 300 is operated in both an ANR mode and a hear-through mode (also referred to as an "aware mode," in which the noise reduction function is turned down for a period of time and part of the ambient sound is allowed to be passed to the user's ears), the microphones 304 and 306 can be disposed away from the periphery of the cushion 310 to reduce likelihood of coupling between the microphones 304 and 306 and a driver (or acoustic transducer) of the ANR headset 300. In the hear-through mode, the microphones capture ambient sounds and the captured sounds are played back through the driver with a gain of unity or more. Placing a microphone near the cushion 310 puts the microphone close to the driver, thereby increasing the likelihood of the microphone picking up the output of the driver. Because such coupling can negatively impact the hear-through mode stability, placing the microphones near the periphery of the cushion 310 may not be ideal if the microphones are also used for a hear-through mode.

Figure 4:
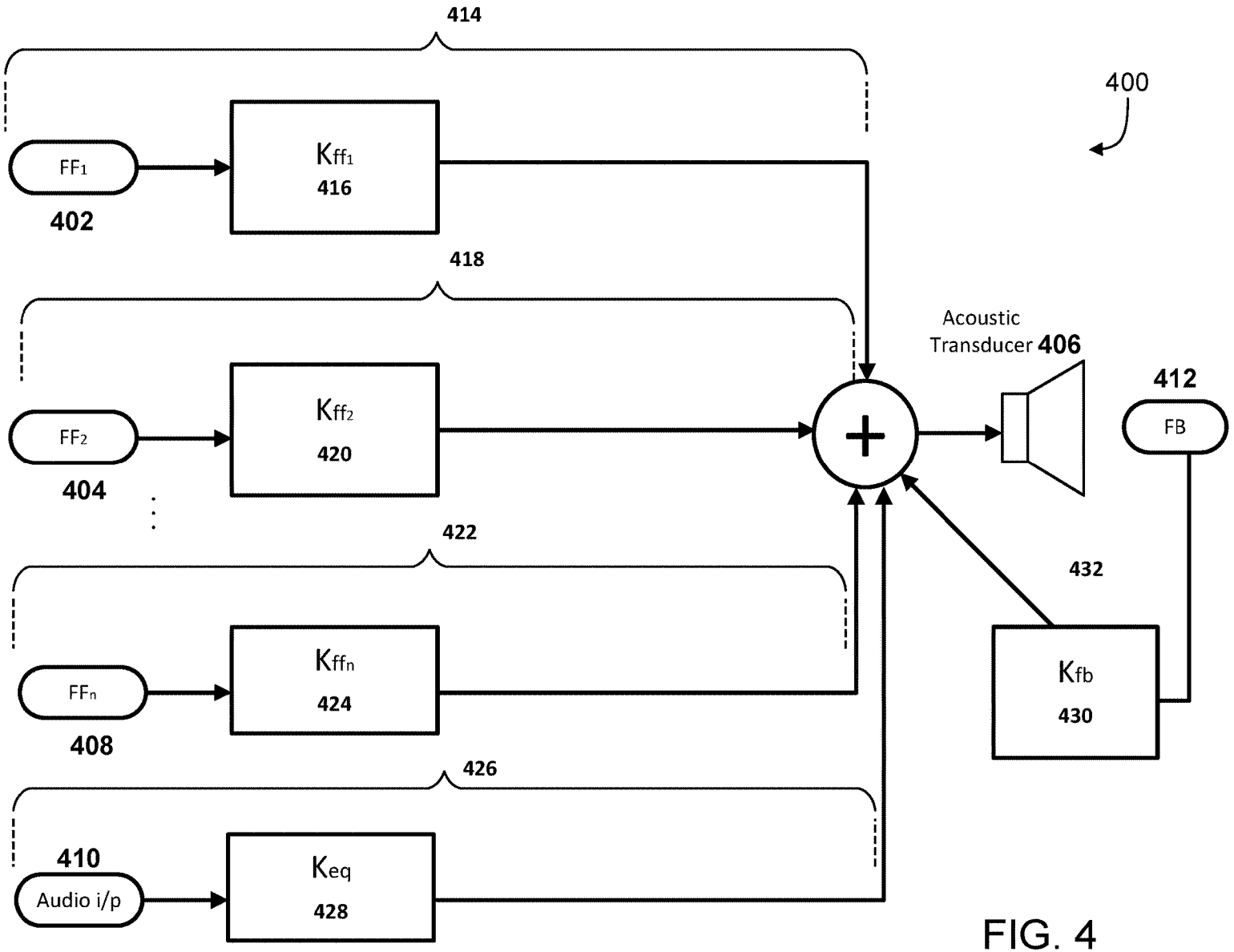
FIG. 4 is a block diagram of an ANR device that has multiple feedforward microphones, with each feedforward microphone having its own controller.

FIG. 4 is a block diagram of an example ANR device that has multiple feedforward microphones. Generally, in the ANR device, each feedforward microphone has its own filter (also referred to as a controller), with the signal generated by each filter being combined to generate a combined signal to be fed to an acoustic transducer (or driver). Various signal flow topologies can be implemented in the ANR device in order to enable functionalities such as audio equalization, feedback noise cancellation, and feedforward noise cancellation. For example, as shown in the example block diagram of an ANR device 400 in FIG. 4, the signal flow topologies can include two or more feedforward signal flow paths (for example, signal flow paths 414, 418 and 422) and optionally, a feedback signal flow path 432 and/or an audio path 426.

In particular, the ANR device 400 includes a first feedforward microphone 402 configured to capture a first input signal $FF_1$ that represents noise traversing a first noise pathway through the ANR device 400. The ANR device 400 includes a first filter 416 disposed in an ANR signal flow path. The filter 416 is configured to process the first input signal to generate a first output signal. The ANR signal flow path can be disposed in a feedforward signal flow path 414 of the ANR device 400. The feedforward signal flow path 414 is disposed between the feedforward microphone 402 and an acoustic transducer 406 of the ANR device.

The ANR device 400 further includes a second feedforward microphone 404 configured to capture a second input signal $FF_2$ that represents noise traversing a second noise pathway through the ANR device 400. The ANR device 400 includes a second filter 420 disposed in an ANR signal flow path. The filter 420 is configured to process the first input signal to generate a first output signal. The ANR signal flow path can be disposed in a feedforward signal flow path 418 of the ANR device 400. The feedforward signal flow path 418 is disposed between the feedforward microphone 404 and the acoustic transducer 406.

The ANR device 400 can optionally include other feedforward microphones, for example, a feedforward microphone 408. The microphone 408 is configured to capture a third input signal $FF_3$ that represents noise traversing a third noise pathway through the ANR device 400. The ANR device 400 includes a third filter 424 disposed in an ANR signal flow path and configured to process the third input signal to generate a third output signal. The ANR signal flow path can be disposed in a feedforward signal flow path 422, which is disposed between the feedforward microphone 408 and the acoustic transducer 406.

In some implementations, two feedforward microphones of the ANR device 400 can use the same filter to process input signals captured by the two feedforward microphones.

In some other implementations, two feedforward microphones can use filters that have a component in common and a separate component. In some cases, this could be done with two completely separate filters. In some other cases, to conserve computational power, the input signals captured by the two microphones could each be processed by a small individual filter to generate a respective output signal. The output signals generated by the small individual filters can be combined together and then processed by a larger common filter.

In some implementations, the signal flow topologies implemented in the ANR device 400 can also include an audio path 426 that includes circuitry (e.g., equalizer 428) for processing input audio signals 410 such as music or communication signals, for playback over the output transducer 406.

In some implementations, the signal flow topologies can include a feedback signal flow path 432 that drives the output transducer 406 to generate an anti-noise signal (using, for example, a feedback filter 430) to reduce the effects of a noise signal FB picked up by the feedback microphone 412.

In some implementations, the feedforward signal flow paths 414, 418, and 422 can include an ANR signal flow path disposed in parallel with a hear-through path. Examples of such configurations are described in U.S. Pat. No. 10,096,313 B1, issued on Oct. 9, 2018, the entire content of which is incorporated herein by reference.

The output transducer 406 is driven by a combined signal generated based on combining the output signals produced by the feedforward filters (e.g., based on combining the first output signal, the second output signal and optionally, the third output signal produced by their respective filters). The output transducer 406 is configured to generate an output audio to the user's ear by generating anti-noise signals to reduce the effects of noise signals picked up by the feedforward microphones 402, 404, and 408 using the filters 416, 420, and 424. In some implementations, the output signal may be combined with one or more additional signals (e.g., a signal produced by a feedback filter 430 of the ANR device 400, and/or a signal produced in an audio path 426 of the ANR device 400, etc.) before being provided to the acoustic transducer 406. The output audio of the acoustic transducer 406 therefore represents a noise-reduced audio combined with any audio representing the ambience as adjusted in accordance with user-preference (e.g. by using aware mode).

Figure 5:
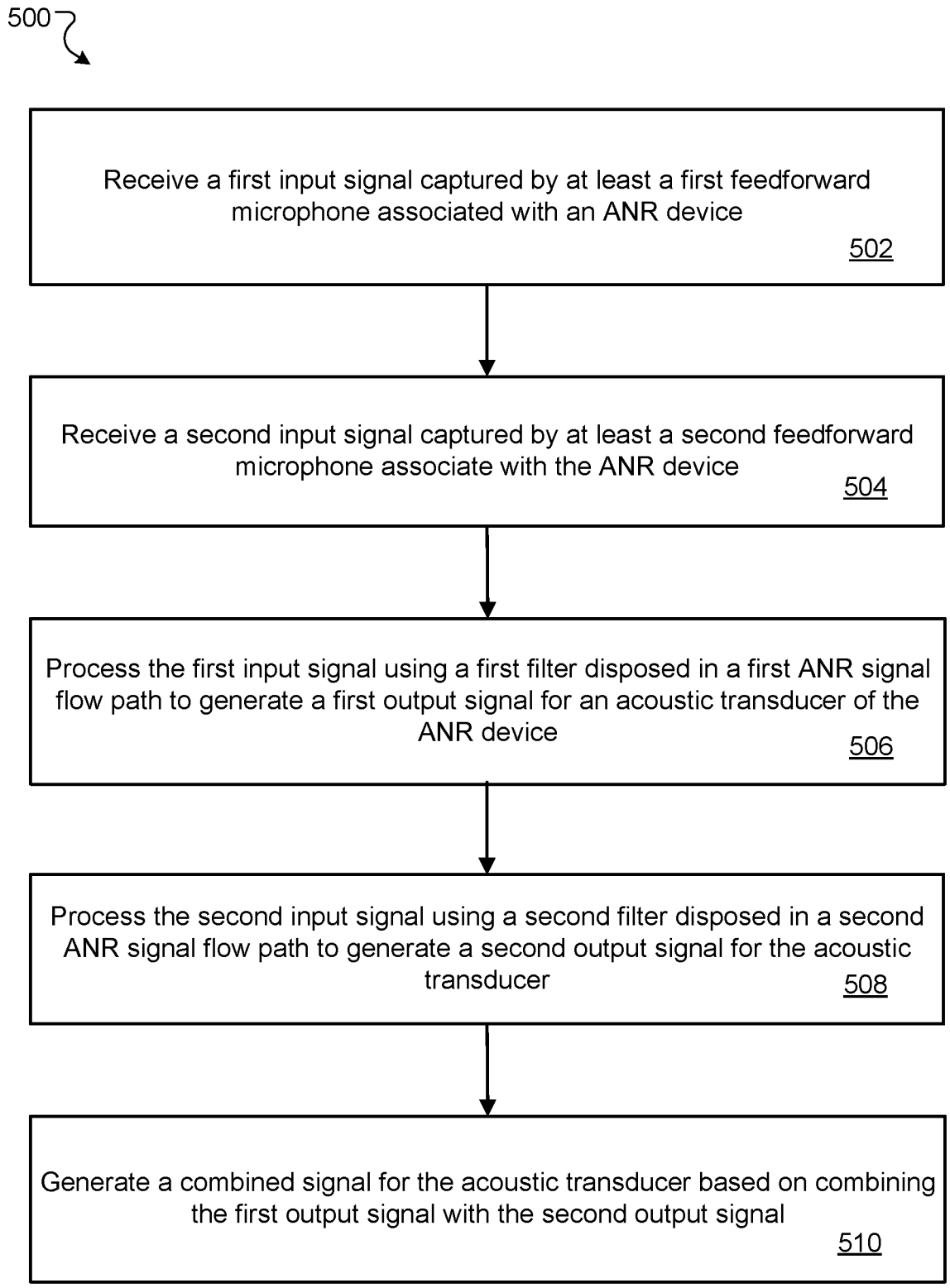
FIG. 5 is a flowchart of an example process for generating an output signal for an acoustic transducer in an ANR device that has multiple feedforward microphones, each feedforward microphone having its own controller.

FIG. 5 is a flowchart of an example process 500 for generating an output signal for an acoustic transducer in an ANR device that has multiple feedforward microphones with each feedforward microphone having its own controller. At least a portion of the process 500 can be implemented using one or more processing devices such as DSPs described in U.S. Pat. Nos. 8,073,150 and 8,073,151, incorporated herein by reference in their entirety.

Operations of the process 500 include receiving a first input signal captured by at least a first feedforward microphone associated with an ANR device (502). In some implementations, the ANR device can be an in-ear headphone such as one described with reference to FIG. 1. In some implementations, the ANR device can include, for example, around-the-ear headphones, over-the-ear headphones (e.g., the ones described with reference to FIG. 2 and FIG. 3), open headphones, hearing aids, or other personal acoustic devices. In some implementations, the first feedforward microphone can be a part of an array of microphones.

Operations of the process 500 also include receiving a second input signal captured by at least a second feedforward microphone associated with the ANR device (504). In some implementations, the second feedforward microphone can be a part of an array of microphones.

In some implementations, at least one of the first or second input signal is captured using multiple microphones.

Operations of the process 500 include processing the first input signal using a first filter disposed in a first ANR signal flow path to generate a first output signal for an acoustic transducer of the ANR device (506). The first ANR signal flow path is disposed in a feedforward signal flow path of the ANR device. The feedforward signal flow path is disposed between the first feedforward microphone and an acoustic transducer of the ANR device. In some implementations, the first filter can be substantially similar to the ANR filter 416 described above with reference to FIG. 4. In some implementations, the first output signal can include an anti-noise signal generated in response to a noise detected by the first feedforward microphone, wherein the anti-noise signal is configured to cancel or at least reduce the effect of the noise. In some implementations, the first filter can be a fixed-coefficient filter.

Operations of the process 500 further include processing the second input signal using a second filter disposed in a second ANR signal flow path to generate a second output signal for the acoustic transducer (508). The second filter is different from the first filter. The second ANR signal flow path is disposed in a feedforward signal flow path of the ANR device. The feedforward signal flow path is disposed between the second feedforward microphone and the acoustic transducer of the ANR device. In some implementations, the second filter can be substantially similar to the ANR filter 420 described above with reference to FIG. 4. In some implementations, the second output signal can include an anti-noise signal generated in response to a noise detected by the second feedforward microphone, wherein the anti-noise signal is configured to cancel or at least reduce the effect of the noise. In some implementations, the second filter can be a fixed-coefficient filter. In some implementations, the coefficients of the second filter may be determined substantially independently of a set of coefficients of the first filter.

The operations of the process 500 also includes generating a combined signal for the acoustic transducer based on combining the first output signal and the second output signal (510). In some implementations, the combined signal may be further combined with one or more additional signals (e.g., a signal produced by a feedback filter of an ANR device, a signal produced in an audio path of the ANR device, etc.) before being provided to the acoustic transducer. The output audio of the acoustic transducer may therefore represent a noise-reduced audio combined with audio representing the ambience as adjusted in accordance with user-preference.

In some implementations, the operations of the process 500 can include receiving a third input signal captured by a third microphone associated with the ANR device and processing the third input signal using a third filter of the ANR device to generate a third signal for the acoustic transducer. In some cases, the third microphone can be a feedforward microphone of the ANR device, and the third filter is disposed in a feedforward signal flow path for the ANR device. In some other cases, the third microphone is a feedback microphone of the ANR device and the third input signal is a feedback signal. In these other cases, the third filter is disposed in a feedback signal flow path, which drives the acoustic transducer to generate an anti-noise signal (by using the third filter) to reduce the effects of noise in the third input signal captured by the feedback microphone.

In the above implementations where there is a third input signal captured by a third microphone, the combined signal for the acoustic transducer is generated based on combining the first output signal, the second output signal, and the third signal.

Figure 6:
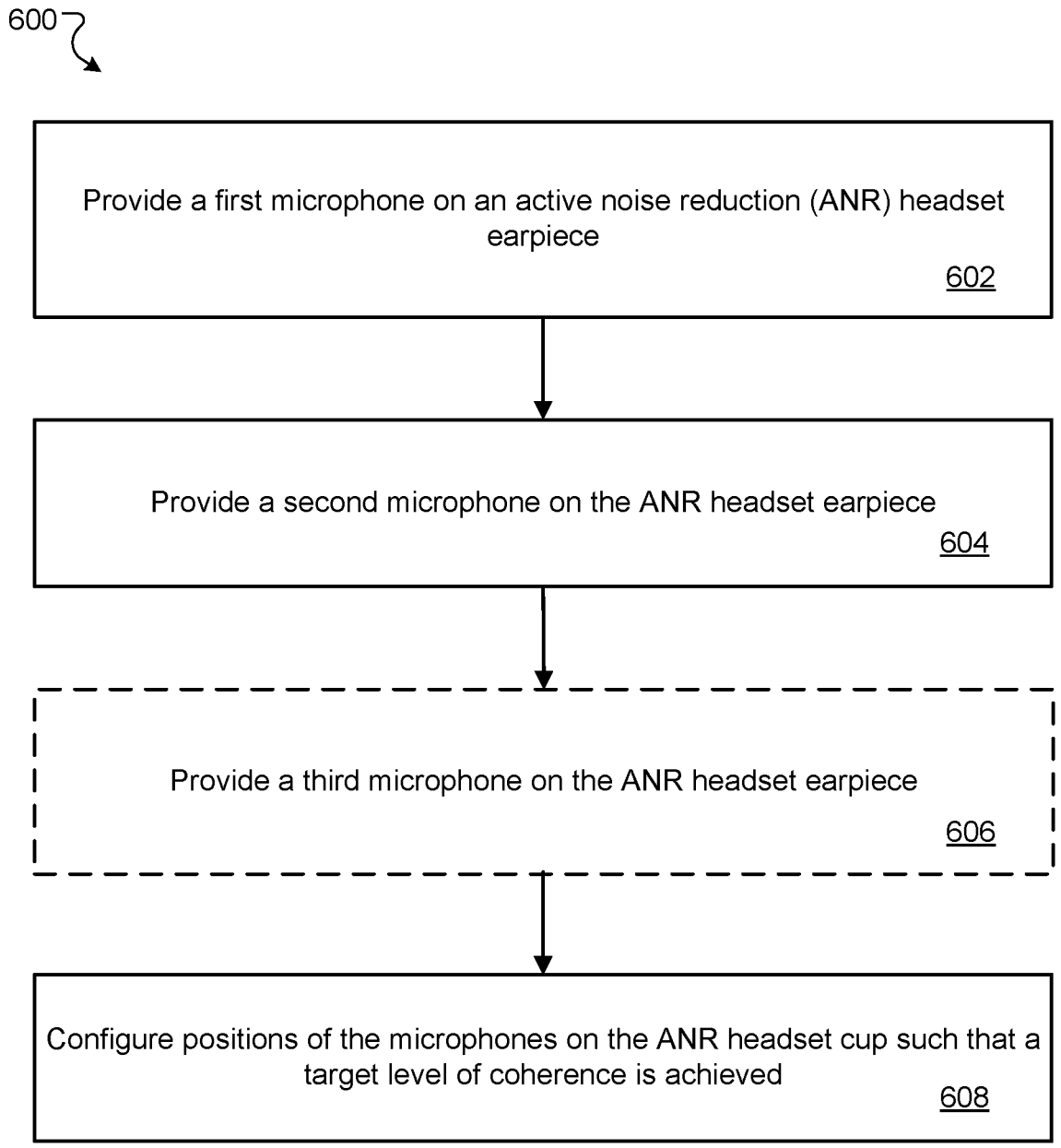
FIG. 6 is a flowchart of an example process for configuring positions of multiple microphones on an ANR headset earpiece such that a target level of coherence is achieved.

FIG. 6 is a flowchart of an example process for configuring positions of multiple microphones on an ANR headset earpiece such that a target level of coherence is achieved.

Operations of the process 600 include providing a first microphone on an active noise reduction (ANR) headset earpiece such that the first microphone is configured to capture a first input signal representing noise traversing a first noise pathway through the ANR headset earpiece (602). Providing the first microphone includes providing a first feedforward microphone. The first noise pathway can be an acoustic path through a cushion of the ANR headset earpiece.

Operations of the process 600 further include providing a second microphone on the ANR headset earpiece such that the second microphone is configured to capture a second input signal representing noise traversing a second noise pathway through the ANR headset earpiece (604). Providing the second microphone includes providing a second feedforward microphone. The second noise pathway can be an acoustic path through a port of the ANR headset earpiece. The port can be one of a resistive port of the ANR headset earpiece or (ii) a mass port of the ANR headset earpiece.

Operations of the process 600 can optionally include providing a third microphone on the headset earpiece such that the third microphone is configured to capture a third input signal representing noise traversing a third noise pathway through the ANR headset earpiece (606). The third noise pathway can be an acoustic path formed though a leak between the cushion of the headset earpiece and the head of a user of the ANR headset earpiece.

Operations of the process 600 include configuring positions of the microphones on the ANR headset cup such that a target level of coherence of the ANR is achieved (608). When there are first and second microphones, the positions of the first and second microphones on the ANR headset earpiece are configured such that a first target level of coherence is achieved at multiple frequencies. The first target level of coherence at a particular frequency represents a fraction of an output signal that can be suppressed using the first input signal and the second input signal together.

When there are first, second, and third microphones, the positions of the first, second, and third microphones are configured such that positions of the first microphone, the second microphone, and the third microphone on the ANR headset cup are configured such that a second target level of coherence is achieved at multiple frequencies. The second target level of coherence at a particular frequency represents a fraction of the output signal that can be suppressed using the first, second, and third input signals together.

The coherence is a single number between 0 and 1 and can be computed using Eq. 5 as described above. The target level of coherence can be a number between 0 and 1, for example, the target level of multiple coherence can be 0.6, 0.7, 0.75, 0.82, or 0.95.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit). In some implementations, at least a portion of the functions may also be executed on a floating point or fixed point digital signal processor (DSP) such as the Super Harvard Architecture Single-Chip Computer (SHARC) developed by Analog Devices Inc.

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

Other embodiments and applications not specifically described herein are also within the scope of the following claims. Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

What is claimed is:

1. A method comprising:

receiving a first input signal captured by at least a first feedforward microphone associated with an active noise reduction (ANR) device;

receiving a second input signal captured by at least a second feedforward microphone associated with the ANR device, wherein the first feedforward microphone and the second feedforward microphone are positioned such that a target level of coherence is achieved at a plurality of frequencies;

processing the first input signal using a first filter disposed in a first feedforward ANR signal flow path to generate a first output signal for an acoustic transducer of the ANR device;

processing the second input signal using a second filter disposed in a second feedforward ANR signal flow path to generate a second output signal for the acoustic transducer, wherein the second filter is different from the first filter; and generating a combined signal for the acoustic transducer based on combining the first output signal with the second output signal.

2. The method of claim 1, wherein at least one of the first or second input signal is captured using multiple microphones.

3. The method of claim 1, further comprising:

receiving a third input signal captured by a third microphone associated with the ANR device;

processing the third input signal using a third filter of the ANR device to generate a third signal for the acoustic transducer; and wherein the combined signal for the acoustic transducer is generated based on combining the first output signal, the second output signal, and the third signal.

4. The method of claim 3, wherein the third filter is different from the first filter and the second filter.

5. The method of claim 3, wherein the third microphone is a feedforward microphone of the ANR device, and wherein the third filter is disposed in a feedforward signal flow path for the ANR device.

6. The method of claim 3, wherein the third input signal is a feedback signal and the third microphone is a feedback microphone of the ANR device.

7. The method of claim 6, wherein the third filter is disposed in a feedback signal flow path, which drives the acoustic transducer to generate an anti-noise signal using the third filter to reduce the effects of noise in the third input signal captured by the feedback microphone.

8. The method of claim 1, wherein the level of coherence represents a fraction of a signal heard by a user of the ANR device that can be cancelled using the first input signal and the second input signal simultaneously.

9. An active noise reduction (ANR) device comprising:

a first feedforward microphone configured to capture a first input signal;

a second feedforward microphone configured to capture a second input signal, wherein the first feedforward microphone and the second feedforward microphone are positioned such that a target level of coherence is achieved at a plurality of frequencies;

an acoustic transducer configured to generate output audio;

a first filter disposed in a first feedforward ANR signal flow path of the ANR device, the first filter configured to process the first input signal to generate a first output signal for the acoustic transducer of the ANR device; and a second filter disposed in a second feedforward ANR signal flow path of the ANR device, the second filter configured to process the second input signal to generate a second output signal for the acoustic transducer, the second filter being different from the first filter, wherein the acoustic transducer is driven by a combined signal that is a combination of the first output signal and the second output signal.

10. The ANR device of claim 9, wherein at least one of the first or second input signal is captured using multiple microphones.

11. The ANR device of claim 9, further comprising:

receiving a third input signal captured by a third microphone associated with the ANR device;

processing the third input signal using a third filter of the ANR device to generate a third signal for the acoustic transducer; and wherein the combined signal for the acoustic transducer is generated based on combining the first output signal, the second output signal, and the third signal.

12. The ANR device of claim 11, wherein the third filter is different from the first filter and the second filter.

13. The ANR device of claim 11, wherein the third microphone is a feedforward microphone of the ANR device, and wherein the third filter is disposed in a feedforward signal flow path for the ANR device.

14. The ANR device of claim 11, wherein the third input signal is a feedback signal and the third microphone is a feedback microphone of the ANR device.

15. The ANR device of claim 14, wherein the third filter is disposed in a feedback signal flow path that drives the output transducer to generate an anti-noise signal to reduce the effects of noise in the third input signal captured by the feedback microphone.

16. The ANR device of claim 9, wherein the level of coherence represents a fraction of a signal heard by a user of the ANR device that can be cancelled using the first input signal and the second input signal simultaneously.

17. One or more machine-readable storage devices having encoded thereon computer readable instructions for causing one or more processing devices to perform operations comprising:

receiving a first input signal captured by at least a first feedforward microphone associated with an active noise reduction (ANR) device;

receiving a second input signal captured by at least a second feedforward microphone associated with the ANR device, wherein the first feedforward microphone and the second feedforward microphone are positioned such that a target level of coherence is achieved at a plurality of frequencies;

processing the first input signal using a first filter disposed in a first feedforward ANR signal flow path to generate a first output signal for an acoustic transducer of the ANR device;

processing the second input signal using a second filter disposed in a second feedforward ANR signal flow path to generate a second output signal for the acoustic transducer, wherein the second filter is different from the first filter; and generating a combined signal for the acoustic transducer based on combining the first output signal with the second output signal.

18. The one or more machine-readable storage devices of claim 17, further comprising:

receiving a third input signal captured by a third microphone associated with the ANR device;

processing the third input signal using a third filter of the ANR device to generate a third signal for the acoustic transducer; and wherein the combined signal for the acoustic transducer is generated based on combining the first output signal, the second output signal, and the third signal.

19. The one or more machine-readable storage devices of claim 18, wherein the third microphone is a feedforward microphone of the ANR device, and wherein the third filter is disposed in a feedforward signal flow path for the ANR device.

20. The one or more machine-readable storage devices of claim 18, wherein the third input signal is a feedback signal and the third microphone is a feedback microphone of the ANR device.

* * * * *